United States Patent [19]

Seidner

[11] Patent Number: 4,856,584

[45] Date of Patent: Aug. 15, 1989

[54] METHOD FOR MONITORING AND CONTROLLING SCALE FORMATION IN A WELL

[75] Inventor: David S. Seidner, Ponca City, Okla.

[73] Assignee: Conoco Inc., Ponca City, Okla.

[21] Appl. No.: 238,939

[22] Filed: Aug. 30, 1988

[51] Int. Cl.[4] ..... E21B 41/02; E21B 43/00; E21B 47/00

[52] U.S. Cl. ..... 166/250; 166/310; 166/902; 250/256

[58] Field of Search ..... 166/250, 247, 279, 310, 166/312, 902, 244.1; 73/151; 250/253, 256, 356.1, 336.1, 260; 252/8.552

[56] References Cited

U.S. PATENT DOCUMENTS

| | | | |
|---|---|---|---|
| 3,385,358 | 5/1968 | Shell | 166/244.1 |
| 4,215,000 | 7/1980 | De Jong et al. | 166/279 X |
| 4,558,592 | 12/1985 | Despax et al. | 73/151 |
| 4,590,996 | 5/1986 | Hoskin et al. | 166/310 X |
| 4,779,679 | 10/1988 | Snavely, Jr. et al. | 166/279 |

FOREIGN PATENT DOCUMENTS

| | | |
|---|---|---|
| 138-080 | 1/1961 | U.S.S.R. . |
| 490-061 | 8/1968 | U.S.S.R. . |
| 834-333 | 4/1979 | U.S.S.R. . |
| 834-647 | 4/1979 | U.S.S.R. . |
| 1056-582 | 2/1982 | U.S.S.R. . |

*Primary Examiner*—Stephen J. Novasad

[57] ABSTRACT

Formation of scale from radioactive components is monitored with a radiation detector. Upon indication of initiation of scale formation in a system, treatment with inhibitor is carried out.

4 Claims, 1 Drawing Sheet

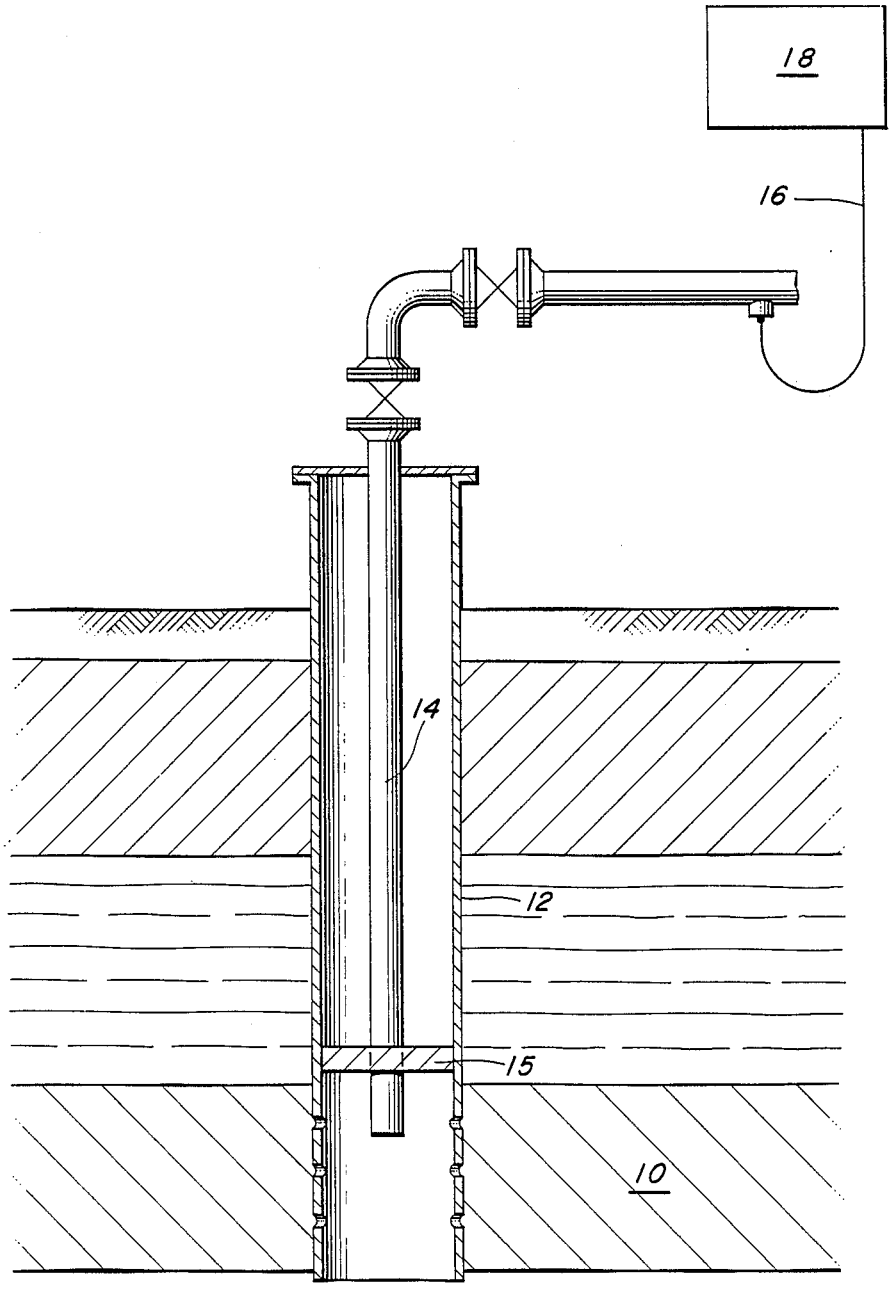
18
16
14
12
15
10

METHOD FOR MONITORING AND CONTROLLING SCALE FORMATION IN A WELL

BACKGROUND OF THE INVENTION

This invention relates to a method of monitoring and controlling scale formation in the flow system of a well, and more particularly to monitoring and controlling scale formation in systems where the scale is comprised of radioactive material.

The accumulation of inorganic mineral scales in oil field formations and production equipment is a major problem for the oil industry. Deposition of inorganic mineral scale in oil-bearing formations and on production tubing and equipment causes significant and costly loss of production. The primary offenders are carbonates and sulfates of calcium, barium and strontium. These compounds may precipitate as a result of changes in pressure, temperature and ionic strength of produced fluids or when connate reservoir waters mix with injected waters during secondary recovery operations. In order to avoid costly losses in production or post-scale treatments it is necessary to prevent deposition of scale downhole as well as in post production processing.

Barium and strontium sulfate scales are of particular concern because of their extremely low solubilities ($10^{-4}$ to $10^{-5}$ Molar $[Ba^{++}]$ depending upon brine concentrations and temperature). At room temperature the solubility of $BaS0_4$ in distilled water is about 2 ppm and at 80° C. is about 4 ppm. In 0.5M NaCl, the solubility is 7 ppm at room temperature and about 30 ppm at 80° C.; in 1.OM NaCl, about 23 and 42 ppm, respectively.

While effective measures have been developed for the removal of calcium carbonate and calcium sulfate scales, barium or strontium sulfate scaling is difficult to treat once it develops.

The most common type of scale inhibition treatment involves periodically squeezing an amount of inhibitor into the formation adjacent a producing well. This is reasonably effective in many cases, although it can lead to significant overtreatment or undertreatment if the treatment interval is not correct for the particular situation.

Another approach that has been used with some success is to monitor a flow condition, such as pressure drop through a part of the flow system, and to treat with inhibitor when the pressure drop indicates scale has formed. This approach works reasonably well for calcium scale, which can be removed with relative ease if necessary. However, for barium or strontium scales, which are difficult to remove once they have formed, it is desirable to know when scale formation has begun, and before enough accumulation has developed to provide a noticeable flow pressure drop in the system, so that an appropriate inhibitor treatment can be initiated prior to irreparable damage to the flow capacity of the system.

SUMMARY OF THE INVENTION

In accordance with the present invention, a process is provided for detecting initial formation of a scale comprised of a radioactive element, and for initiating an inhibition treatment before a flow-damaging amount of scale has formed.

It is important in situations where barium or strontium scale is prone to form that prevention be started before sufficient scale has developed to cause significant loss of flow capacity in the system, since removal of such scales is sometimes not practical. While naturally occurring barium and strontium are not highly radioactive, scales formed from these materials often include sufficient radium or other highly radioactive material such that a small amount of the scale can be easily detected with conventional radiation measuring equipment.

In the process of this invention, a radiation detector or rate meter appropriate to the radioactive component or components of the anticipated scale is located at one or more locations in the flow system, calibrated to take into account the normal radiation level resulting from fluid flow in the system, and then monitored for an increase in radiation level indicative of initial scale formation. Upon indication of scale formation, an inhibitor treatment is carried out. The radiation detector can easily be tied in to an automated well or field control system.

DRAWINGS

The FIGURE is a schematic illustration of a monitoring system for use in the process of the invention.

DESCRIPTION OF THE PREFERRED EMBODIMENT

The process of the preferred embodiment of the invention will be described with reference to the drawing, it being understood that the drawing is merely illustrative of one of many possible versions.

A perforated well casing 12 having production tubing 14 and packer 15 disposed therein extends into subterranean formation 10. A radiation detector 16 is shown positioned above ground on the flow system of the well. Radiation detector 16 is connected to rate meter 18 which may be at the well site or remotely located from the well site.

Generally, the potential scale type likely to affect a well or group of wells is known, and an initial inhibitor treatment is applied in a conventional manner prior to putting the well into production. Thereafter, periodic retreatment is required to provide continuing protection, all as is well-known in the art. In cases where barium or strontium is a potential scale-forming element, it is important to carry out the periodic retreatments before a large amount of scale has formed, as these barium or strontium scales are very difficult to remove once they have formed.

The process involves applying an inhibitor to the flow system, then monitoring the radiation level at a point in the flow system which is prone to scale formation.

When the radiation detector (which has been calibrated to take into account the radiation level during normal flow) indicates a significant increase in radiation level from the beginning of scale buildup, a further inhibitor treatment is applied. In cases of barium and strontium scales, an increase in radioactivity can be detected before enough scale has formed to significantly affect fluid flow characteristics of the system, unlike conventional calcium scale monitors which measure pressure drops through the flow system. This is important since barium and strontium scales, unlike most calcium scales, are very difficult to remove. The process of the invention enables retreatment to be carried out before significant flow capacity is lost, and still avoids overtreating which can occur when a retreatment is arbitrarily carried out on a conservative schedule to insure against loss of flow capacity.

The radiation detector can be located at any location in the flow system where scale formation is a problem, such as the inlet of tubing 14 adjacent the subterranean formation 10, or above ground in the well production piping as shown in the drawing. More than one detector may be used in a single well.

The process is particularly useful in the case of computer-operated wells or fields, as the monitored radiation level can be used as input to a control system to stop well flow or to initiate inhibitor treatment as necessary.

OPERATION

A typical operation utilizing the process of the invention on a well which is known to have barium or strontium scale-forming elements in its produced fluids involves initially treating the well with scale inhibitor in a conventional manner, and then putting the well into production. During production, the radiation level at one or more potential scale formation locations is monitored, and upon detection of an increase in radioactivity above the level measured during normal operation, a subsequent inhibitor treatment is carried out, either manually or automatically, so that the amount of scale does not build up to a point that flow capacity is significantly reduced.

I claim:

1. A method for inhibiting formation of scale in the flow system of a well which is subject to formation of radioactive scale comprising the steps of:

(a) applying a scale inhibitor treatment to the flow system;

(b) monitoring the radiation level at a point in the flow system which is subject to formation of said scale; and (c) upon obtaining a radiation level at said point in an amount greater that the background level during normal operation, applying additional scale inhibitor treatment to said system.

2. The method of claim 1 wherein said radioactive scale is comprised of barium sulfate and a radioactive material.

3. The method of claim 1 wherein said radioactive scale is comprised of strontium sulfate and a radioactive material.

4. The method of claim 1 wherein said monitored radiation level is reported to a computerized well control facility which initiates application of inhibitor treatment upon receipt of an indication of radioactive level above said background level.

* * * * *